United States Patent [19]

Boettcher et al.

[11] Patent Number: 4,550,273

[45] Date of Patent: Oct. 29, 1985

[54] EIGHT ELECTRODE OPTICAL READOUT GAP

[75] Inventors: Gordon E. Boettcher; Robert W. Crain, both of Albuquerque, N. Mex.

[73] Assignee: The United States of America as represented by the Department of Energy, Washington, D.C.

[21] Appl. No.: 488,338

[22] Filed: Apr. 25, 1983

[51] Int. Cl.[4] ..... H05B 37/02; H05B 39/04; H05B 41/36

[52] U.S. Cl. ..... 315/151; 324/403; 250/209; 315/120; 315/129; 315/134; 315/149; 361/129; 361/131

[58] Field of Search ..... 315/134, 129, 149, 150, 315/151, 338, 340, 120; 340/638; 361/129, 131, 2; 324/403, 414; 250/208, 209

[56] References Cited

U.S. PATENT DOCUMENTS

| | | | |
|---|---|---|---|
| 3,487,261 | 12/1969 | Boksjo et al. | 315/151 X |
| 4,063,130 | 12/1977 | Hunter, Jr. | 315/150 |
| 4,157,486 | 6/1979 | Fegley | 340/638 |
| 4,177,404 | 12/1979 | Eguchi | 315/151 |
| 4,187,526 | 2/1980 | Heinze et al. | 361/129 |
| 4,393,433 | 7/1983 | Anderson et al. | 361/129 |
| 4,431,947 | 2/1984 | Ferriss et al. | 315/151 |
| 4,463,284 | 7/1984 | Tamura et al. | 315/151 |

*Primary Examiner*—Saxfield Chatmon

*Attorney, Agent, or Firm*—George H. Libman; Albert Sopp; Judson R. Hightower

[57] ABSTRACT

A protective device for a plurality of electrical circuits includes a plurality of isolated electrodes forming a gap with a common electrode. An output signal, electrically isolated from the circuits being monitored, is obtained by a photosensor viewing the discharge gap through an optical window. Radioactive stabilization of discharge characteristics is provided for slowly changing voltages and carbon tipped dynamic starters provide desirable discharge characteristics for rapidly varying voltages. A hydrogen permeation barrier is provided on external surfaces of the device.

17 Claims, 4 Drawing Figures

FIG. 4
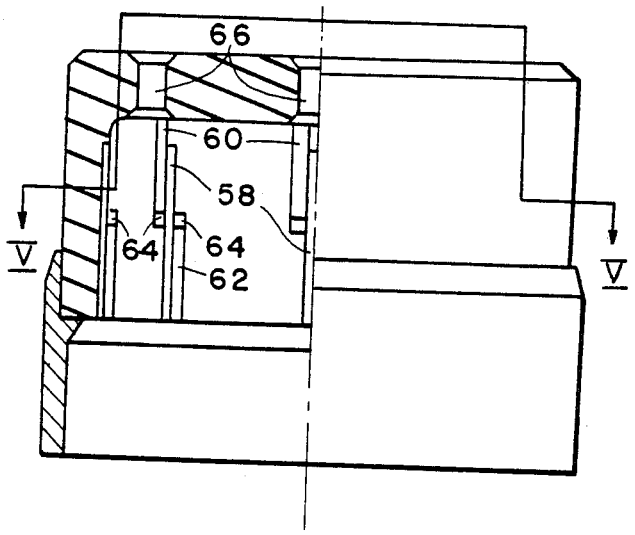
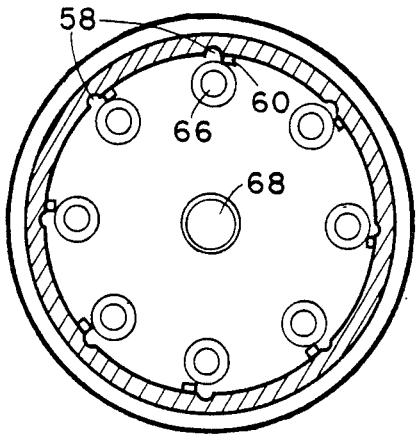
FIG. 5

EIGHT ELECTRODE OPTICAL READOUT GAP

The United States government has rights in this invention pursuant to contract No. DE-AC04-76DP00789 between the United States Department of Energy and the Western Electric Company.

BACKGROUND OF THE INVENTION

This invention relates to protective devices for electrical connectors exposed to high voltages, and more specifically to a multi-electrode device for monitoring and protecting a plurality of electrical connectors.

Prior art protective and monitoring devices for electrical contacts and connectors are known. Such protective devices typically monitor a single contact or connector pair and provide an output discharge signal in response to the presence of an excessive voltage on the protected connector. Bulky transformers are required to isolate any protective or monitoring circuitry from the circuit being monitored.

There is thus a need in the prior art for simplified protective devices providing isolated outputs without requiring the use of bulky transformers.

Multi-electrode over-voltage gaps are known in the prior art, but, similarly to the single connector pair protective devices described above, such multi-electrode devices also require bulky isolation transformers. Accordingly, there is a need in the prior art for multi-electrode protective devices to provide compact monitoring and protection for electrical connectors or contacts independently of any isolation transformers.

Electical circuits also require protection from high voltage pulses having fast rise times. Prior art protective gas discharge devices, however, are incapable of providing stable breakdown voltages for rapidly changing voltages on the monitored circuits. There is accordingly a need in the prior art to provide protective devices for electrical connectors having stabilized voltage breakdown characteristics, both for DC voltage levels and for fast rising voltage pulses.

Spark gap protective devices are frequently encased in organic materials for protection and packaging. Under storage conditions, such organic materials are capable of emitting hydrogen gas. The hydrogen gas can permeate through nickel, copper or nickel-cobalt alloys into the gas filled discharge chamber, thus changing the purity of the fill-gas and its breakdown voltage. There is thus a need in the prior art for protective devices which may be encased in organic materials but which, nonetheless, are not subject to the negative effects of hydrogen permeation.

SUMMARY OF THE INVENTION

It is accordingly an object of the present invention to overcome the difficulties of the prior art and to provide a protective device for one or more pairs of electrical connectors and providing an output isolated from the monitored connectors.

It is a more specific object of the invention to provide a protective device for electrical connectors in which isolation between the monitored connectors and the output signals is provided by opto-isolation.

Yet a more specific object of the invention is the provision of an integral opto-isolation device within a protective device, including an optical window and a photodiode.

It is another object of the invention to provide a protective device for electrical connectors in which breakdown voltage is stabilized for voltages ranging from DC to fast rise-time pulse voltages.

It is a more specific object of the invention to provide radioactive material within a discharge gap of a protective device for stabilizing the breakdown voltage thereof for slowly varying voltages.

Still a further object of the invention is the provision of a protective device for electrical connectors in which bipolar starting means is provided for stabilizing the breakdown voltage thereof for rapidly varying voltages.

A more specific object of the invention is the provision of starting means for a protective device formed of carbon tipped metalized strips on opposite sides of a groove formed adjacent an electrode of the protective device.

Still another object of the invention is the provision of a protective device for electrical connectors in which a barrier is provided for preventing permeation of hydrogen into the discharge gap.

Additional objects, advantages and other novel features of the invention will be set forth in part in the description that follows and in part will become apparent to those skilled in the art upon examination of the following description, or may be learned with the practice of the invention. The objects and advantages of the invention may be realized and attained by means of the instrumentalities and combinations particularly pointed out in the appended claims.

To achieve the foregoing and other objects and in accordance with the purposes of the present invention as described herein, an improved protective device is provided for monitoring a pair of electrical connectors. The protective device includes a housing and first and second electrodes. The electrodes are, in turn, connected to the connectors to be protected and form a discharge gap within the housing. An optical detector is provided for detecting a discharge between the electrodes. The optical detector provides an output signal indicative of the detected discharge, and is electrically isolated from the two electrodes.

In a further aspect of the invention, in accordance with its objects and purposes, there is provided a protective device for electrical connectors including a barrier for prevention of hydrogen permeation through its housing.

In accordance with other objects of the invention, there is provided a protective device for electrical connectors including a means for stabilizing the breakdown voltage within the discharge gap for voltages ranging from DC to a particular high rate of voltage change.

In accordance with still other objects of the invention, there is provided a protective device for a plurality of electrical connectors including a housing and a plurality of electrodes, passing through the housing, connected to the various connectors to be connected. A common electrode forms a discharge gap with each of the plurality of electrodes. An optical detector is used to detect a discharge between the common electrode and any of the plural electrodes and to provide an output signal which is electrically isolated from the electrodes and indicative of any such discharge.

Preferably, the inventive protective device for a plurality of connectors includes a radioactive source for stabilizing the discharge voltage across the discharge gap. Additionally, bipolar starters are provided adjacent each of the electrodes within the housing. Moreover, a coating of Sn-Pb is provided on external metal surfaces of the housing as a barrier against hydrogen permeation through the housing.

Preferably, the optical detector includes a sapphire optical window for viewing the discharge and a photodetector, symmetrically disposed with respect to the plural electrodes. The starter preferably includes a plurality of grooves on the inner surface of the housing, each groove formed adjacent one of the plural electrodes, with carbon tipped metalized strips on opposite sides of each groove.

Still other objects of the present invention will become readily apparent to those skilled in this art from the following description wherein there is shown and described a preferred embodiment of the invention, simply by way of illustration of one of the modes best suited to carry out the invention. As will be appreciated, the invention is capable of other, different embodiments, and its several details are capable of modifications in various obvious aspects, all without departing from the invention. Accordingly, the drawings and descriptions will be regarded as illustrative in nature and not as restrictive.

BRIEF DESCRIPTION OF THE DRAWINGS

The drawings, incorporated in and forming a part of the specification, illustrate several aspects of the present invention and, together with the description, serve to explain the principles of the invention. In the drawings:

FIG. 4 provides an elevation view, partially in section, of a housing of the invention; and FIG. 5 provides a top view, partially in section, of the housing of the invention taken along line V—V in FIG. 4.

Reference will now be made in detail to the preferred embodiment of the invention, an example of which is illustrated in the accompanying drawings.

DETAILED DESCRIPTION OF THE INVENTION

Figure 1:
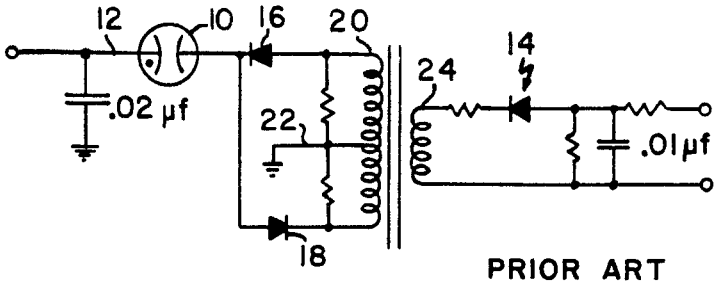
PRIOR ART FIG. 1
FIG. 1 shows a prior art protective device.

Reference is now made to FIG. 1, showing a prior art protective device 10 monitoring an electrical apparatus connected to a terminal 12 thereof. In that regard, it should be understood that protection for various electrical devices against application of high voltages or voltage surges may be had by providing an overvoltage path, through the protective device 10, to ground. Alternatively, a discharge within the protective device 10 may be detected by associated monitoring circuitry, through pulse shaping circuitry shown generally at 14. The specific monitoring circuit is not shown, but may be used to disconnect the high voltage applied to the device, to provide a short circuit for the overvoltage, or to provide other penalties to the undesired voltage.

It should be further noted that the protective devices contemplated herein may be used for protection of electrical contacts, electrical devices or circuits, electrical lines or connectors, or other electrical components. Hereinafter, reference to "electrical connectors" includes any and all such components being monitored or protected by the protective device.

As shown in FIG. 1, the protective device 10 is connected through a full wave rectifying circuit comprising diodes 16 and 18 to a center tapped transformer primary 20. Thus, positive or negative high voltages detected on the monitored connector are discharged to ground through center tap 22. Additionally, as a result of the discharge within device 10 an output signal is provided by a secondary winding 24 to the pulse shaping circuitry 14 which, in turn, outputs a pulse to the monitoring circuitry. It is noted that, although other connections might be made from the output of protective device 10 to the monitoring circuit, the transformer 20 is required in order to isolate the ground system of the monitoring circuit from that of the circuit being monitored. Thus, the prior art circuitry requires a bulky and expensive transformer to be used with each connector being monitored. For protection of eight such connectors, eight primary windings are required.

Figure 2:
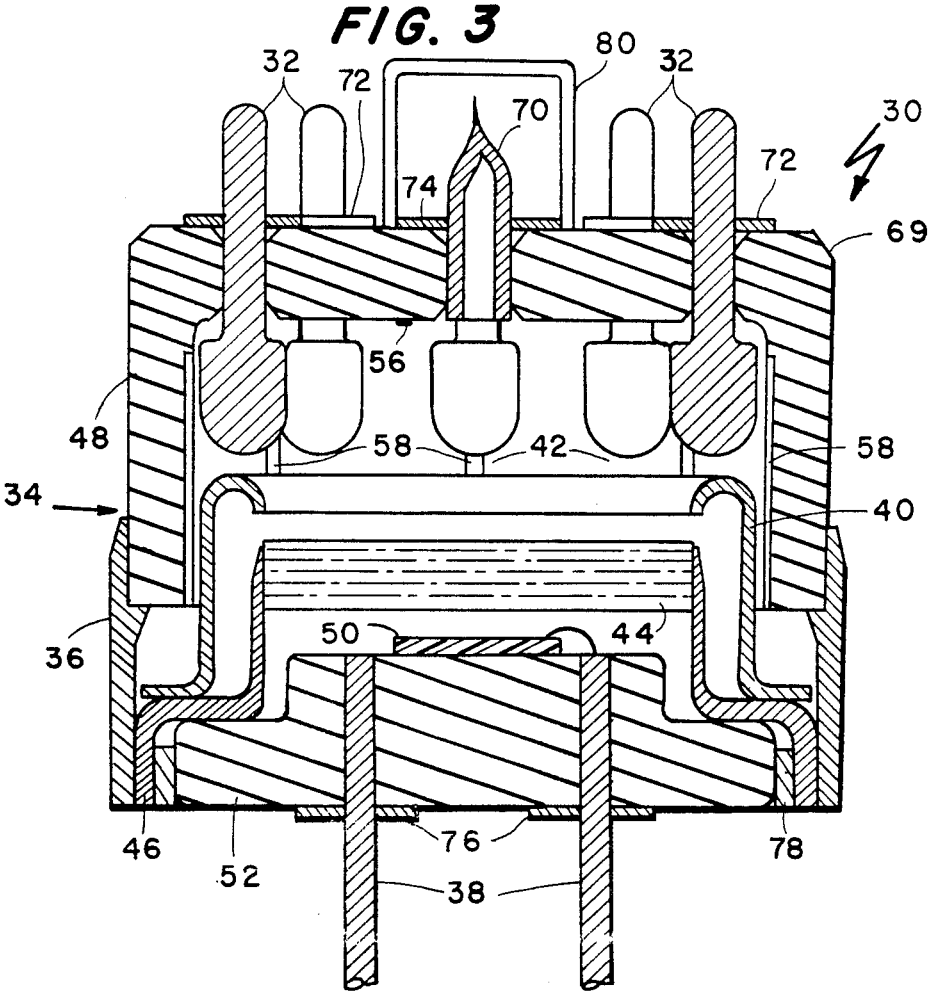
FIG. 2 illustrates a preferred embodiment of the present invention.

In accordance with the objects of the present invention, the inventive structure shown in FIG. 2 eliminates the prior art requirement of providing transformer isolation between the monitored connector and a monitoring circuit. Additionally, as will become apparent from the following description, the structure of FIG. 2 includes a number of additional advantages.

Referring to the inventive structure of FIG. 2, the improved protective device is generally shown at 30 as including a plurality of electrodes 32, a housing 34 including a common electrode 36, and output leads 38.

Preferably, eight isolated electrodes 32 are provided, although any number may be utilized. That is, the concept of the inventive device may be used for monitoring a single electrical connector or a plurality of such connectors. An electrode ring 40 is provided within the housing 34 and connected to the external electrode 36. A common discharge gap 42 is provided between electrodes 32 and electrode ring 40. Housing 34 is filled with an inert gas, such as argon at a pressure of 150 mm, in order to provide an argon glow discharge in response to detection voltages in excess of a predetermined threshold on the monitored connectors.

In accordance with the invention there is provided an optical window 44, sealingly engaged with housing 34 by a support structure 46. The inert gas is sealed in the space formed between optical window 44, support structure 46 and housing 34, which includes the common electrode 36 and a ceramic envelope 48, preferably comprising 94% $A1_2O_3$.

A silicon photodiode 50 is disposed atop a ceramic support structure 52 and is connected to the two output leads 38.

In operation, the presence of a high voltage on any one or more of the electrical connectors being monitored leads to a discharge in the gap 42 between the appropriate electrode and electrode ring 40. The discharge is viewed through optical window 44 by photodiode 50, resulting in an output signal on output leads 38. Since photodiode 50 is electrically isolated from all of the electrodes 32 and common electrode 36, the signal on leads 38 requires no further isolation from the connectors being monitored. The inventive structure thus provides an integrated device delivering an output signal in response to detection of an overvoltage condition on any of a plurality of monitored electrical connectors.

Figure 3:
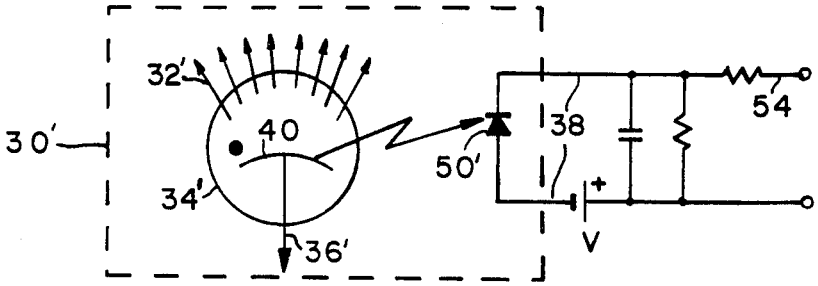
FIG. 3 shows a schematic representation of improved monitoring circuitry incorporating the invention.

FIG. 3 shows an application of the inventive device for monitoring the several connectors protected thereby. Thus, referring to the electrical representations of structural components of FIG. 2 by the addition of a prime, it is seen that the inventive device 30′ includes a plurality of electrodes 32′ for connection to a number of connectors to be protected. Gas filled housing 34′ provides discharges between electrodes 32′ and common electrode 36′ at an electrode ring 40′. The discharge within housing 34′ is optically coupled to a photodiode (or other optically sensitive device) 50′, thereby providing an output signal on leads 38 isolated from the protected connectors. Of course, other isolated couplings may also be utilized in the inventive structure including, for example, thermal couplings or electromagnetic couplings, for example.

It is seen that the detection of a discharge by photodiode 50′ results, in a well known manner, in the generation of a pulse at output terminal 54. Thus, a monitoring circuit utilizing the inventive device advantageously protects a plurality of connectors without the use of a single transformer winding and further without requiring the use of separate full wave rectifying circuits for each of the connectors being monitored.

The circuit of FIG. 3 more particularly functions in conjunction with a 7.4 volt bias battery as follows. Upon break-down in the discharge gap between one or more of the electrodes 32 and the electrode ring 40, the light produced by the gaseous breakdown changes the impedance of silicon photodiode 50′. In response to the impedance change of the photodiode, current flows to charge the 0.01 $\mu$f capacitor towards the bias voltage. The amount of peak current switched through the electrode gap varies the light intensity, in turn determining the photodiode impedance. A 2.5 volt output at terminal 54 provides a satisfactory signal, and is available in response to a 2 mA gap current. Higher currents merely drive the circuit into saturation. Thus, a simpler, smaller, less costly and more reliable monitoring circuit is provided with the use of the present invention.

As a further feature of the invention, there is provided within housing 34 a radioactive portion 56 for stabilizing voltage breakdown characteristics within the protective device. Preferably, radioactive carbon 14 is located in the housing. Although it is known to utilize radioactive material in gaseous form (e.g. tritium) to speed ionization of a gas and thereby to cause faster breakdown of a spark gap, tritium can be absorbed by most metals. When absorbed by the electrodes or the envelope of a spark gap, the effect of the radioactivity is reduced, thus minimizing the desired stabilization of breakdown voltage.

The present invention, utilizing a 5 $\mu$C inert radiation source, for example, provides breakdown characteristic stabilization without alteration of the fill gas properties by mixing of the radioactive material therewith. Moreover, unlike radioactive stabilizers of tritium or nickel 63, the presently preferred stabilizer does not plate on surfaces within the gap.

It should be understood, however, that in environments wherein low discharge currents are expected between the electrodes, nickel 63 may indeed provide an acceptable source of radiation. Moreover, for a low current embodiment, plating of nickel 63 or other radioactive sources into the common electrode ring is acceptable since the ring surface will not erode rapidly. Where such erosion is expected, as in high discharge current environments, carbon 14 is the preferred source of radioactivity.

More specifically, the preferred form of the radioactive source is carbon 14 in an amorphous form, rubbed into a spot on one of the interior surfaces of the ceramic envelope 48, the excess being removed with vacuum cleaning.

In any event, the present invention utilizes radiation within acceptable limits to provide stabilization of breakdown voltage characteristics for voltages which do not vary excessively rapidly. A different stabilization technique is utilized for rapidly varying voltages, however, since excessively high radiation would be required for stabilization of breakdown characteristics in such an environment.

In that regard, another feature of the invention is seen in FIGS. 2, 4 and 5. Therein, a plurality of dynamic starters are provided for the isolated electrodes 32 of the device.

Referring specifically to FIG. 2, a plurality of grooves 58 are provided in an internal surface of ceramic envelope 48 adjacent the isolated electrodes. As seen in FIG. 5, the grooves are preferably radially displaced from each of the electrodes within the gap.

Associated with each groove 58 are a pair of starter elements 60 and 62. Two such dynamic starter elements are provided for each electrode in order to achieve substantially identical fast rise trigger discharge for gap breakdown in response to monitored voltages of either polarity. The dynamic starter elements 60 and 62 are preferably formed as metalized strips on opposite sides of each groove, the strips having carbon tipped portions shown at 64. Preferably, dynamic starter elements 60 are capacitively coupled with electrodes 32, while dynamic starters 62 are capacitively coupled with electrode ring 40. Grooves 58 advantageously separate starters 60 and 62 even within a structure of small physical dimensions, thus permitting miniaturization of the inventive device.

The dynamic starters, in combination with the radioactive stabilizer, provide a stable breakdown voltage characteristic for applied voltages ranging from DC to rise times on the order of 10 kV/$\mu$s.

In yet another advantageous feature of the invention, there is provided a barrier to prevent the permeation of hydrogen through the housing into the discharge gap. Specifically, spark gap devices, similarly to other electrical devices, are frequently potted in organic materials for protection and packaging. The advantages of such an arrangement are well known. However, the organic materials utilized to protect the devices may emit hydrogen gas under storage conditions. Although the generated gas may be harmless under some circumstances, such a gas is capable of permeating through nickel, copper, or nickel-cobalt alloys such as might be used in the housing of the present invention. The presence of the hydrogen (or any other gas) in the sealed discharge chamber changes the fill-gas purity and thus the breakdown voltage between the electrodes. In accordance with the present invention, there is provided a tin-lead coating on the external metal surfaces of the inventive structure in order to prevent permeation of hydrogen therethrough. Consequently, the voltage breakdown characteristics for the present invention are still less subject to change and deterioration, even when the device is placed in storage for extended periods of time.

In combination, the radioactive stabilizer, the permeation barrier coating and the dynamic starting strips thus provide stable and predictable characteristics for the device over an extended period of time. A twenty year shelf life is contemplated therefor.

Referring again to FIGS. 2 and 5, it is seen that the electrodes 32 are symmetrically distributed about the sapphire optical window in order to permit viewing and detection by the photosensor of a glow discharge on any of the electrodes within the discharge gap.

Preferably, the ceramic envelope 48 is provided with a plurality of chamfered passageways 66 for electrodes 32, as shown in FIGS. 4 and 5. A separate, central, chamfered passageway 68 is provided for a copper pinch-off tube 70, shown in FIG. 2. The passageways are chamfered to avoid a necessity to provide sharp corners on ceramic envelope 48. In that regard, it is noted that a chamfered shoulder 69 is provided at the intersection of the upper horizontal surface of envelope 48 and the cylindrical vertical position thereof.

Metalizing patterns are provided on the upper surface of ceramic envelope 48 surrounding each of the chamfered passageways 66 and 68.

A plurality of electrode pin disk washers 72 are provided for the electrodes 32 and a pinch-off support washer 74 is similarly provided, as shown in FIG. 2. Additional washers 76 are provided at metalization patterns provided on support structure 52 for connection to output leads 38. Preferably washers 73, 74 and 76 are formed of kovar to enable the same to be brazed to the metalizing patterns provided on the ceramic supports therefor and thus to fix the associated electrode pins and output leads to the appropriate support structures.

Fabrication of the inventive device as hereinabove described proceeds as follows. Washers 72, 74 and ring 36 are copper brazed to ceramic envelope 48. In a separate operation, the pinch-off tube 70 and pins 32 are brazed to envelope 48.

A separate subassembly, including support 46 having sapphire optical window 44 copper brazed therein and electrode ring 40 laser welded thereto, is laser welded at the mating of 36 and 46. In the remaining subassembly, washers 76 with wires 38 and 78 are copper brazed into ceramic support 52. Photodiode 50 is then bonded to the upper surface of the ceramic support 52, and leads 38 are connected to photodiode 50. This last subassembly is now laser welded at the mating of ring 78 and 46, as shown in FIG. 2, in a clean $N_2$ atmosphere.

All the metal parts except the pinch-off tube are preferably made of kovar to facilitate brazing and laser welding. An argon gas fill is performed through pinch-off tube 70, the pinch-off tube thereafter being sealed and protected by a protective cap 80. A dip coat process is used to provide a Sn/Pb coating on the metalic surfaces of the device in order to provide the hydrogen permeation barrior thereover.

The foregoing disclosure thus provides a protective device for one or more electrical connectors. The inventive apparatus provides an output signal which is optically isolated from the connectors being monitored, using an optical window and a photosensor integral with the protective device. Stabilizers are provided for the former and a field injection starting device is provided for the latter. Miniaturization of the inventive apparatus is enabled by provision of separating grooves between the bipolar starting devices and further by provision of reduced diameter electrodes passing through the housing, the electrode providing an increased diameter as necessary within the protective gap.

The foregoing description of the preferred embodiment of the invention has been presented for purposes of illustration and description. It is not intended to be exhaustive or to limit the invention to the precise form disclosed. Obvious modifications or variations are possible in light of the above teachings, several such variations having been described in the specification. The embodiment was chosen and described to provide the best illustration of the principles of the invention and its practical application, thereby to enable one of ordinary skill in the art to utilize the invention in various embodiments and with various modifications as are suited to the particular use contemplated. It is intended that the scope of the invention be defined by the claims appended hereto.

We claim:

1. A protective device for monitoring a pair of electrical connectors comprising:
   - a housing comprising an electrically insulating envelope;
   - first and second spaced electrode means connected to the connectors to be protected and forming a discharge gap within said housing;
   - discharge means within said housing for discharging responsively to a predetermined voltage across said discharge gap between said first and second electrode means;
   - dynamic starter means adjacent said gap for initating a fast rise time discharge within said gap, said means comprising a groove adjacent said electrode means in an inner surface of said envelope and a pair of metalized strips on opposite sides of said groove; and
   - optical detecting means for detecting said discharge between said first and second electrode means and including output means for providing an output signal indicative of said discharge;
   - said detecting means being electrically isolated from said electrode means.

2. A protective device for monitoring a plurality of electrical connectors comprising:
   - a housing;
   - a plurality of electrically isolated electrode means passing through said housing for connection to the electrical connectors to be protected;
   - a common electrode means forming a discharge gap with each of said plurality of electrode means;
   - discharge means within said housing for discharging responsively to a predetermined discharge voltage across said discharge gap between said common electrode means and any of said plurality of electrode means; and
   - optical detecting means for detecting said discharge between said common electrode means and any of said plurality of electrodes and including output means for providing an output signal indicative of said discharge;
   - said detecting means being electrically isolated from the electrode means within the housing.

3. A protective device as recited in claim 2, further comprising;
   - radioactive means within said housing for stablizing said discharge voltage across said discharge gap.

4. A protective device as recited in claim 3, wherein said radioactive source means comprises carbon 14.

5. A protective device as recited in claim 2, wherein said discharge means comprises inert gas within said housing at a predetermined pressure.

6. A protective as recited in claim 2, further comprising barrier means for providing a barrier to hydrogen permeation through said housing, said barrier means comprising a coating of Sn-Pb on external metal surfaces of said housing.

7. A protective device as recited in claim 2, wherein said housing further comprises optical window means for transmitting therethrough an optical indication of said discharge, said window means being affixed between said common electrode and said housing.

8. A protective device as recited in claim 7, wherein said optical detecting means comprises photosensitive means disposed within said housing for receiving said optical indication through said optical window means and for providing said output signal.

9. A protective device as recited in claim 8, wherein said photosensitive means comprises photodiode means and said optical window means comprises a sapphire optical window for viewing breakdown discharge between electrodes in said discharge gap.

10. A protective device as recited in claim 2, further comprising a plurality of discharge starting means in said housing for initiating fast rise time discharges in said discharge gap, each of said discharge starting means being operatively associated with one of said plurality of electrodes.

11. A protective device as recited in claim 10, wherein each of said discharge starting means comprises first starting means for initiating discharge responsive to potential differences of a first polarity, in excess of said predetermined discharge voltage, between said common electrode means and any of said plurality of electrode means.

12. A protective device as recited in claim 11, wherein each of said discharge starting means comprises second starting means for initiating discharges responsive to potential differences of a second polarity, in excess of said predetermined discharge voltage, between said common electrode means and any of said plurality of electrode means.

13. A protective device as recited in claim 12, further comprising separating means between each of said first and second starting means.

14. A protective device as recited in claim 13, wherein each said separating means comprises a separating groove on an inner surface of said housing, said first and second starting means disposed on opposite sides of said separating groove.

15. A protective device as recited in claim 14 wherein said first and second starting means each comprises a metalized strip on opposite sides of said groove from one another.

16. A protective device as recited in claim 2, wherein said housing comprises a high alumina ceramic envelope.

17. A protective device as recited in claim 2, wherein said plural electrode means are symmetrically disposed about said optical detecting means thereby providing substantially identical viewing and detection conditions for discharges associated with any of said electrode means.

* * * * *